United States Patent [19]

Oakley

[11] Patent Number: 4,864,740

[45] Date of Patent: Sep. 12, 1989

[54] DISPOSABLE HYGIENIC SHOE INSOLE AND METHOD FOR MAKING THE SAME

[75] Inventor: Barbara A. Oakley, Menasha, Wis.

[73] Assignee: Kimberly-Clark Corporation, Neenah, Wis.

[21] Appl. No.: 945,411

[22] Filed: Dec. 22, 1986

[51] Int. Cl.[4] ..... A43B 13/38

[52] U.S. Cl. ..... 36/44; 36/43; 12/142 N

[58] Field of Search ..... 36/43, 44, 8.4, 71; 12/142 N, 146 M

[56] References Cited

U.S. PATENT DOCUMENTS

| | | | |
|---|---|---|---|
| 1,780,574 | 11/1930 | Williams | 36/44 |
| 2,121,604 | 6/1938 | Lynch et al. | 36/44 |
| 3,143,812 | 8/1964 | Bittner | 36/8.4 |
| 3,417,494 | 12/1968 | Claff | 36/44 |
| 3,852,897 | 12/1974 | Bridge et al. | 36/44 |
| 4,015,347 | 4/1977 | Morishita et al. | 36/44 |
| 4,055,699 | 10/1977 | Hsiung | 36/44 |
| 4,099,342 | 7/1978 | Singh | 36/44 |
| 4,137,110 | 1/1979 | Singh | 36/44 |
| 4,185,402 | 1/1980 | Digate | 36/44 |
| 4,192,086 | 3/1980 | Sichak | 36/44 |
| 4,387,516 | 6/1983 | Laux | 36/43 |
| 4,464,850 | 8/1984 | Ebert et al. | 36/44 |
| 4,602,442 | 7/1986 | Revill et al. | 36/44 |

FOREIGN PATENT DOCUMENTS

| | | | |
|---|---|---|---|
| 77363 | 4/1918 | Switzerland | 36/44 |

*Primary Examiner*—Steven N. Meyers
*Attorney, Agent, or Firm*—John L. Chiatalas

[57] ABSTRACT

A disposable hygienic shoe insole comprises three layers; a top layer of a spunbonded polypropylene material, a composite layer of pulp fibers and polypropylene fibers meltblown onto the top layer, and a bottom layer of polyethylene vinyl acetate meltblown onto the composite layer. The layers, preferably the composite layer, can include antimicrobial agents, fragrance, or neutralizer or odor-absorbing agents. The top surface of the top layer is provided with good abrasion resistance, and the bottom surface of the bottom layer provides required friction to maintain the shoe insole in place during use.

42 Claims, 1 Drawing Sheet

DISPOSABLE HYGIENIC SHOE INSOLE AND METHOD FOR MAKING THE SAME

BACKGROUND OF THE INVENTION

This invention pertains to a shoe insole, and more particularly to a hygienic shoe insole that is disposable and can include an antimicrobial, fragrant, and odor-absorbing agent.

Various types of shoe insoles are available, some of which are intended to last the lifetime of the shoe and others which are intended to be replaced daily. Those insoles which are intended to last the lifetime of the shoe, or for an extended period of time, such as four to six weeks before replacing, are generally made of foams or plastics filled with air or liquid. During the intended lifetime of these types of insoles, they tend to deteriorate and lose some of their properties, such as an intended cushion effect or odor control. Also, since they are exposed over a relatively long period of time to the moisture and odor of the foot, the shoe in which they are used can tend to retain the wetness and odor. Another disadvantage with these types of shoe insoles is that they are relatively expensive due to their construction.

Another type of shoe insole is that which is intended to be changed daily. These types of insoles are relatively less expensive than the above-described insoles. However, they tend not to be as effective in controlling wetness and odor.

SUMMARY OF THE INVENTION

The present invention provides a disposable hygienic shoe insole intended to be used for periods of approximately one week, depending upon the wetness or odor generated by the user, and comprising a unique combination of layers of nonwoven materials.

In one form of the invention, there is provided a disposable hygienic shoe insole comprising a top layer made of a nonwoven plastic material having a top surface and a bottom surface, a pulp and polymer fiber composite layer adhered to the bottom surface of the top layer, and a bottom layer made of a nonwoven plastic material having a top surface and a bottom surface, the top surface being adhered to the pulp and polymer fiber composite layer.

In another form of the invention, there is provided a method of making a disposable hygienic shoe insole comprising the steps of providing a top layer of a nonwoven plastic material having a top surface and a bottom surface, depositing on the bottom surface of the top layer a pulp and polymer fiber composite layer, and then applying to the pulp and polymer fiber composite layer a bottom layer of a nonwoven plastic material having a top surface and a bottom surface, the top surface being next to the pulp and polymer fiber composite layer.

BRIEF DESCRIPTION OF THE DRAWINGS

The above-mentioned and other features and objects of this invention, and the manner of attaining them, will become more apparent and the invention itself will be better understood by reference to the following description of an embodiment of the invention taken in conjunction with the accompanying drawings, wherein.

DESCRIPTION OF A PREFERRED EMBODIMENT

Figure 1:
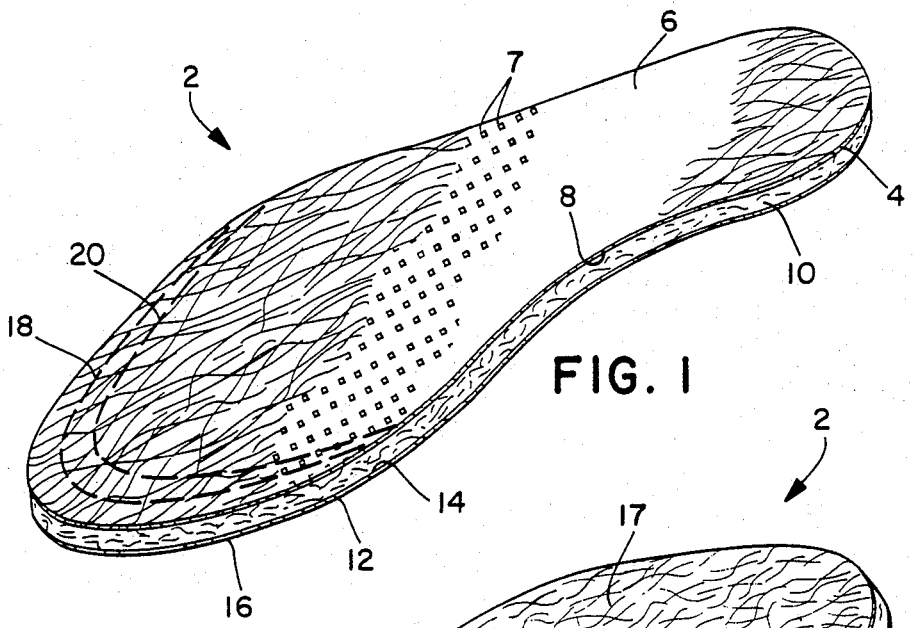
FIG. 1 is a top perspective view of an embodiment of the present invention.

Referring to FIG. 1, disposable hygienic shoe insole 2 of the present invention is illustrated and comprises top layer 4, having top surface 6 and bottom surface 8, pulp and polymer fiber composite layer 10, and bottom layer 12 having top surface 14 and bottom surface 16.

Top layer 4 is preferably made of spunbonded polypropylene fibers having good abrasion resistance on top surface 6. A good degree of abrasion resistance exists when top layer 4 is tested with a Stoll Abrasion Tester using a three-pound weight and shows minimal abrasion after 100 cycles, such that no holes appear or only a few fibers have delaminated from top surface 6. Additional abrasion resistance can be provided by embossing top layer 4, as indicated by embossments 7, or increasing its basis weight.

Alternate materials of which top layer 4 can be made are spunbonded polyester or nylon fiber material, or a powder-bonded carded web of polyester or nylon fiber material. Other useful embodiments of top layer 4 include meltblown polymers, such as polypropylene, polyester, and nylon; or a composite of meltblown and spunbonded materials.

In addition to embossing top surface 6 in order to increase the abrasion resistance thereof, another means for increasing abrasion resistance is to saturate top layer 4, which can be made of a lighter weight material, with a rubber or acrylic latex.

Useful basis weights for top layer 4 are between about 24 $g/m^2$ to about 70 $gm^2$, and preferably a basis weight between about 35 $g/m^2$ to about 50 $g/m^2$. In a specific embodiment, an optimum basis weight is about 40 $g/m^2$.

Composite layer 10 comprises a blend of wood pulp and polymer fibers in a percentage weight amount of about 50% pulp fibers and 50% polymer fibers to about 80% pulp fibers and 20% polymer fibers. Preferably, the blend is 70% wood pulp fibers and 30% polymer fibers. The polymer fibers are preferably polypropylene fibers. Composite layer 10 is deposited on bottom surface 8 of top layer 4 by meltblowing the polypropylene fibers into a pulp fluff air stream directed toward bottom surface 8. Preferably, top layer 4 is a spunbonded polypropylene, since this makes it temperature compatible with the polypropylene fibers of composite layer 10, thereby providing adherence between top layer 4 and composite layer 10. When top layer 4 is made of another type of polymer, such as polyester or nylon, binding agents may be necessary to adhere top layer 4 to composite layer 10, or the layers 4 and 10 can be adhered or attached by bonding, such as sonic bonding. Regardless of the particular polymer material of which top layer 4 is made, it is preferred that the adherence strength or force between top layer 4 and composite layer 10 be at least 0.5 kg and preferably greater than 1.0 kg.

Composite layer 10 may also include other materials, such as antimicrobial agents, which are effective against odor-causing bacteria or fungi. Examples of antimicrobial agents include a number of bacteriocides and/or fungicides, for example, metal compounds of zinc, copper, aluminum, or cobalt. Other usable agents include quaternary ammonium compounds, sorbic acid, and citrates. Yet another means of eliminating or decreasing the number of bacteria or fungi is to provide an environment in which they cannot live by, for example, altering the pH of the environment.

Fragrance may also be added to composite layer 10 in order to enhance the cleanliness and freshness of shoe insole 2. A useful concentration range of these fragrant materials is between about 2 mg to about 5 mg per gram of shoe insole 2.

Another means of treating shoe insole 2 is by adding a neutralizing or odor-absorbing agent to composite layer 10, such as activated carbon.

Although the addition of antimicrobial agents, fragrance, and/or neutralizing or odor-absorbing agents has been made with reference to composite layer 10, the present invention contemplates their addition to top layer 4 and/or bottom layer 12, in any type of combination. For example, antimicrobial agents could be added to composite layer 10 during the meltblowing thereof, and activated carbon could be added to bottom layer 12 as it is formed on composite layer 10, as described below.

A useful basis weight of composite layer 10 is between about 100 g/m$^2$ to about 300 g/m$^2$, and a preferable basis weight is between about 150 g/m$^2$ to about 200 g/m$^2$. In a specific embodiment, an optimum basis weight is 190 g/m$^2$. Depending upon the basis weight of composite layer 10, it is desirable that it result in an overall thickness of shoe insole 2 between about 1/10 to about ¼ inch. Preferably, the overall thickness of insole 2 is ⅛ inch.

Bottom layer 12 is preferably a meltblown elastomeric or tacky polymer, such as meltblown polyethylene vinyl acetate. Preferably the polyethylene vinyl acetate has an amount of vinyl acetate in a percentage weight between about 15% to about 20%. The meltblown polyethylene vinyl acetate also has the advantage of providing bottom surface 16 with a relatively high coefficient of friction, thereby resulting in the fibers providing an antiskid surface 17 and preventing shoe insole 2 from moving during use. The coefficient of friction, as measured by applying bottom surface 16 to a steel plate, should preferably be greater than 170 grams. This type of bottom layer 12, i.e., a meltblown polymer, also has the additional advantage of being breathable.

Polymers useful during this meltblowing of bottom layer 12 on composite layer 10 include Kraton® polymers available from Shell Chemical Company, Polytrope® polymers available from A. Schulman Company, Estane® polymers available from B. F. Goodrich Chemical Company, and polyethylene methacrylate polymers wherein the methacrylate is present in a percentage weight amount between about 20% to about 30%. Also, elastomeric or tacky polymers may be combined during the meltblowing process with less expensive polymers, such as polypropylene or polyethylene, up to a weight ratio of about 40%. For example, a useful meltblown polymer blend is a combination of Kraton® and polyethylene in a percentage weight ratio of about 60% Kraton® to about 40% polyethylene.

Other useful alternatives for bottom layer 12 are low-tack adhesive coatings and films extruded or laminated on composite layer 10. However, an advantage of meltblown polymers is their breathability.

A useful basis weight of bottom layer 12 is between about 20 g/m$^2$ to about 80 g/m$^2$, and preferably a basis weight between about 35 g/m$^2$ to about 60 g/m$^2$. In a specific embodiment, an optimum basis weight is 40 g/m$^2$. As with layers 4 and 10, depending upon the basis weight of bottom layer 12, it should preferably have a thickness between about 1 to about 3 mils. Also, abrasion resistance can be increased by increasing the basis weight.

Regarding layers 10 and 12, the adherence strength or force between bottom layer 12 and composite layer 10 should be at least 0.3 kg. Preferably, the adherence between bottom layer 12 and composite layer 10 is greater than 1.0 kg. Also, it is desirable that the meltblown polymer of which bottom layer 12 is made be compatible with the polypropylene in composite layer 10, so that the layers may be heat and pressure embossed to enhance the bond. However, if the polymers of which bottom layer 12 are made are not temperature compatible with the polypropylene in composite layer 10, then binding agents may be needed to adhere layers 10 and 12. Also, bonding methods may be used for attachment or adherence, such as sonic bonding.

Figure 3:
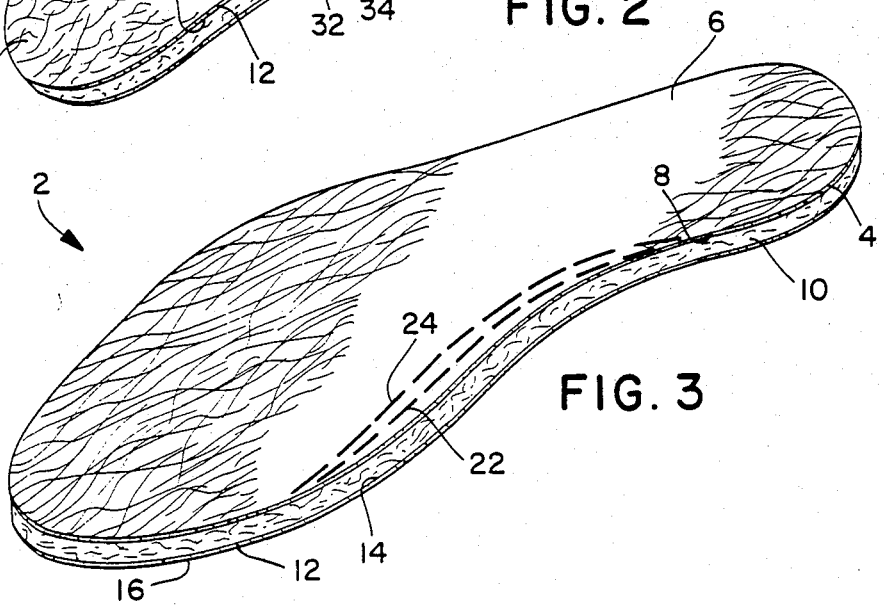
FIG. 3 is a top perspective view of yet another embodiment of the present invention.

Referring to FIGS. 1 and 3, lines of perforation 18, 20, 22, and 24 can be provided in shoe insole 2. The cut areas of line perforations 18–24 are preferably in the range of about 1/16 inch to about ⅛ inch, and uncut areas in line perforations 18–24 are preferably between about 1/32 inch to about 1/16 inch. In FIG. 1, line perforations 18 and 20 are provided to decrease the length of shoe insole 2, while maintaining its width. In FIG. 3, line perforations 22 and 24 are provided for narrowing the width of shoe insole 2, while maintaining its length. Although not illustrated, the present invention contemplates shoe insole 2 having line perforations 18–24 together, so that the user can reduce both the length and width of shoe insole 2. Also, the outermost line perforations, for example, line perforation 18 and line perforation 22, are perforated such that they are easier to manually tear than the innermost line perforations 20 and 24. Naturally, shoe insole 2 is not required to have any lines of perforation and can be provided as a one-size only insole.

Figure 2:
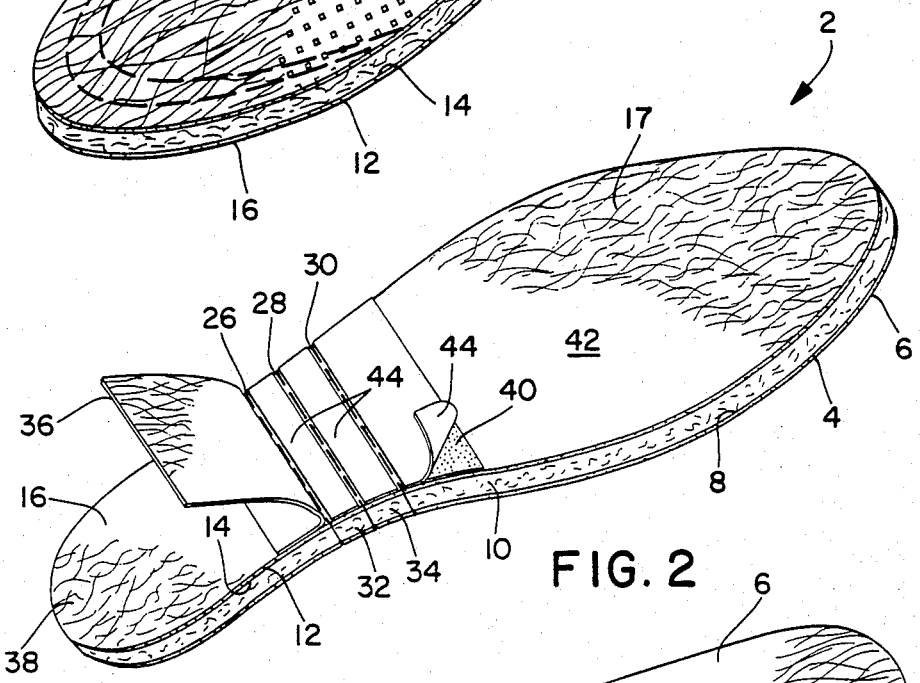
FIG. 2 is a bottom perspective view of another embodiment of the present invention.

Referring to FIG. 2, another method of adjusting the length of shoe insole 2 is to provide lines of perforation 26, 28 and 30 across the arch area of insole 2. Line perforations 26–30 define therebetween portions 32 and 34 of shoe insole 2 which may be removed, either singly or together, by manually tearing along a selected line perforation 26, 28, or 30. Re-attachment of the two separated portions of shoe insole 2 are provided by a flap 36 which is adhered to heel section 38, and adhesive 40 which is applied to the proximal end portion of toe section 42 and exposed by removing release paper 44. Thus, to decrease the length of shoe insole 2 in FIG. 2, either portion 32 or portion 34, or both, can be manually separated along their respective line perforations 26–30, and then heel and toe sections 38, 42 can be rejoined by removing release paper 44 and attaching flap 36 to adhesive 40. Because flap 36 is in the arch area of shoe insole 2, there is minimal discomfort or feel by the user since the arch area is weighted less than the rest of insole 2.

While this invention has been described as having a preferred embodiment, it will be understood that it is capable of further modifications. This application is therefore intended to cover any variations, uses, or adaptations of the invention following the general principles thereof, and including such departures from the present disclosure as come within known or customary practice in the art to which this invention pertains and fall within the limits of the appended claims.

What is claimed is:

1. A disposable hygienic shoe insole, comprising:

a top layer having a top surface and a bottom surface, and being made of a nonwoven material, a pulp and polymer fiber composite layer being adhered to said bottom surface of said top layer, a bottom layer having a top surface and a bottom surface, and being made of a nonwoven material, said top surface being adhered to said pulp and polymer fiber composite layer, a first perforation means disposed across predetermined portions of said top layer, said pulp and polymer fiber composite layer, and said bottom layer for selectively manually removing certain ones of said predetermined portions, and a reusable adhesive means on said bottom surface of said bottom layer for readhering said layers together.

2. The shoe insole of claim 1 wherein said pulp and polymer fiber composite layer is a blend of pulp fibers and polypropylene fibers, said blend being in a percentage weight range of about 50% pulp fibers and about 50% polypropylene fibers to about 80% pulp fibers and about 20% polypropylene fibers, and wherein said pulp and polymer fiber composite layer has a basis weight between about 100 $g/m^2$ to about 300 $g/m^2$.

3. The shoe insole of claim 1 wherein said top layer is made of a spunbonded polypropylene, polyester, or nylon material, and has a basis weight between about 24 $g/m^2$ to about 70 $g/m^2$.

4. The shoe insole of claim 1 wherein said top layer is made of a powder-bonded carded web of polypropylene, polyester, or nylon material, and has a basis weight between about 24 $g/m^2$ to about 70 $g/m^2$.

5. The shoe insole of claim 1 wherein said top layer is made of a meltblown polypropylene, polyester, or nylon material, and has a basis weight between about 24 $g/m^2$ to about 70 $g/m^2$.

6. The shoe insole of claim 1 wherein said top layer is a composite of meltblown and spunbonded materials.

7. The shoe insole of claim 1 wherein said bottom layer is made of a meltblown polyethylene vinyl acetate or polyethylene methacrylate material, and has a basis weight between about 20 $g/m^2$ to about 80 $g/m^2$.

8. The shoe insole of claim 7 wherein said meltblown bottom layer is combined with meltblown polypropylene or meltblown polyethylene, wherein said meltblown polypropylene or said meltblown polyethylene can comprise up to about 40% by weight of the total weight of said bottom layer.

9. The shoe insole of claim 7 wherein said meltblown polyethylene vinyl acetate is between about 15% to about 20% by weight vinyl acetate, or wherein said polyethylene methacrylate is between about 20% to about 30% by weight methacrylate.

10. The shoe insole of claim 1 wherein said bottom layer is made of a meltblown elastomeric material.

11. The shoe insole of claim 1 wherein said bottom layer is an extruded film of polyethylene vinyl acetate or polyethylene methacrylate material.

12. The shoe insole of claim 1 wherein said bottom layer is an extruded film of elastomeric material.

13. The shoe insole of claim 1 wherein said bottom layer is an extruded film of low-tack adhesive material.

14. The shoe insole of claim 1 wherein said bottom layer is an extruded film of polymeric material, with a film of low-tack adhesive extruded thereon.

15. The shoe insole of claim 1 further comprising an antiskid means on said bottom surface of said bottom layer for preventing movement of said shoe insole during use, said antiskid means providing a coefficient of friction of at least 170 grams.

16. The shoe insole of claim 1 wherein the adherence between said top layer and said pulp and polymer fiber composite layer is at least about 0.5 kg, and wherein the adherence between said pulp and polymer fiber composite layer and said bottom layer is at least about 0.3 kg.

17. The shoe insole of claim 1 wherein said pulp and polymer fiber composite layer includes an antimicrobial agent.

18. The shoe insole of claim 17 wherein said antimicrobial agent is a metal compound of zinc, copper, aluminum, or cobalt.

19. The shoe insole of claim 17 wherein said antimicrobial agent is a quaternary ammonium compound.

20. The shoe insole of claim 17 wherein said antimicrobial agent is a sorbic acid.

21. The shoe insole of claim 17 wherein said antimicrobial agent is a citrate.

22. The shoe insole of claim 1 wherein said pulp and polymer fiber composite layer includes a fragrant material in an amount of about 2 mg to about 5 mg of fragrant material per gram of said shoe insole.

23. The shoe insole of claim 1 wherein said pulp and polymer fiber composite layer includes activated carbon as a neutralizer or odor-absorber.

24. The shoe insole of claim 1 wherein said top surface of said top layer is embossed to provide abrasion resistance thereto.

25. The shoe insole of claim 1 wherein said top layer is saturated with a rubber or acrylic latex to provide abrasion resistance thereto.

26. The shoe insole of claim 1 further comprising a second perforation means along predetermined portions of peripheries of said top layer, said pulp and polymer fiber composite layer, and said bottom layer for selectively manually tearing away certain ones of said portions, whereby the size of said shoe insole can be fitted for use.

27. A method of making a disposable hygienic shoe insole, comprising the steps of:

spunbonding a top layer of a nonwoven material having a top surface and a bottom surface, meltblowing on the bottom surface of the top layer a pulp and polymer fiber composite layer, and meltblowing onto the pulp and polymer fiber composite layer a bottom layer of nonwoven material having a top surface and a bottom surface, the top surface being next to the pulp and polymer fiber composite layer.

28. The method of claim 27, wherein the top layer of nonwoven material is a polypropylene, polyester, or nylon material.

29. The method of claim 27 wherein the step of spunbonding further includes the step of meltblowing.

30. A method of making a disposable hygienic shoe insole, comprising the steps of:

meltblowing a top layer of a nonwoven material having a top surface and a bottom surface, depositing on the bottom surface of the top layer a pulp and polymer fiber composite layer, and meltblowing onto the pulp and polymer fiber composite layer a bottom layer of a nonwoven material having a top surface and a bottom surface, the top surface being next to the pulp and polymer fiber composite layer.

31. A method of making a disposable hygienic shoe insole, comprising the steps of:

carding a top layer of a nonwoven material having a top surface and a bottom surface depositing on the bottom surface of the top layer a pulp and polymer fiber composite layer, and meltblowing onto the pulp and polymer fiber composite layer a bottom layer of a nonwoven material having a top surface and a bottom surface, the top surface being next to the pulp and polymer fiber composite layer.

32. The method of claim 27 wherein depositing the pulp and polymer fiber composite layer is by meltblowing polypropylene fibers into an air stream of pulp fluff in a percentage weight range of about 50% pulp fluff and about 50% polypropylene fibers to about 80% pulp fluff and about 20% polypropylene fibers.

33. The method of claim 27 wherein the bottom layer is a polyethylene vinyl acetate or polyethylene methacrylate material.

34. The method of claim 33 further including meltblowing polypropylene or polyethylene in an amount up to about 40% by weight of the total weight of the bottom layer.

35. The method of claim 27 wherein the bottom layer is an elastomeric material.

36. The method of claim 27 further comprising the step of disposing an antimicrobial agent in one of the top layer, the pulp and polymer fiber composite layer, and the bottom layer.

37. The method of claim 27 further comprising the step of disposing a fragrant material in one of the top layer, the pulp and polymer fiber composite layer, and the bottom layer.

38. The method of claim 27 further comprising the step of disposing a neutralizer or odor-absorber in one of the top layer, the pulp and polymer fiber composite layer, and the bottom layer.

39. The method of claim 27 further comprising the step of embossing the top surface of the top layer.

40. The method of claim 27 further comprising the step of saturating the top layer with a rubber or acrylic latex.

41. The method of claim 27 further comprising the step of perforating predetermined portions of the top layer, the pulp and polymer fiber composite layer, and the bottom layer, whereby certain portions can be selectively manually removed.

42. A disposable hygienic shoe insole made by the method of claim 27, 30 or 31.

* * * * *